United States Patent [19]

Mybeck

[11] Patent Number: 4,675,163

[45] Date of Patent: Jun. 23, 1987

[54] LABORATORY DEVICE

[76] Inventor: Jessica F. Mybeck, 4929 E. Paradise Dr., Scottsdale, Ariz. 85254

[21] Appl. No.: 843,591

[22] Filed: Mar. 25, 1986

[51] Int. Cl.[4] ..... B01L 3/02

[52] U.S. Cl. ..... 422/100; 73/863.33; 73/864.16; 141/237; 141/243; 222/237; 422/63; 422/73

[58] Field of Search ..... 141/237, 242, 243; 73/863.31, 863.33, 863.03, 864.16, 864.17, 864.18; 422/63, 100, 104, 73; 222/235–237

[56] References Cited

U.S. PATENT DOCUMENTS

| | | | |
|---|---|---|---|
| 2,709,538 | 5/1955 | Harrington | 141/242 |
| 3,498,342 | 3/1970 | Sanderson | 222/137 |
| 4,258,761 | 3/1981 | Bennett, Jr. | 73/363.32 |
| 4,545,507 | 10/1985 | Barall | 222/137 |

FOREIGN PATENT DOCUMENTS

| | | | |
|---|---|---|---|
| 2504269 | 1/1976 | Fed. Rep. of Germany | 422/100 |
| 55-131770 | 10/1980 | Japan | 73/863.32 |

*Primary Examiner*—Michael S. Marcus

*Attorney, Agent, or Firm*—Richard R. Mybeck

[57] ABSTRACT

A laboratory device having a bifurcatable actuator plate assembly superposed and in coaction with a support plate means for securing a plurality of pump-actuated pipettes therebetween and responsive to the actuation thereof to accurately dispense liquids therefrom during a single cycle of the actuator and means for readily establishing a preselected quantity for the replicate liquid injections. The device is supported by height adjustable legs having rubber feet mounted thereto to insure stability.

11 Claims, 5 Drawing Figures

10
27
11
23
25
28
29
26
30
30
30
30
23
3
41
43
17
12
45
40
54
52
55
14
56
16
14
54
3
50
15
16
13
16

36
61
23
11
35
34
37
31
17
62
60
18
19
32
43
45
33
41
42
52
39
56
40
46
12
48
47
50
13
51
53
24
15
16

23
22
11
18
21
20

19
14
12
13

LABORATORY DEVICE

INTRODUCTION

The present invention relates to a laboratory device and more particularly to a laboratory appliance comprising means for simultaneously innoculating a pluraity of the same or dissimilar test materials, each with the same or one of a plurality of different test reagents each having a predetermined relationship with the test material to produce a reaction having a meaningful response to a trained laboratory technician.

BACKGROUND OF THE INVENTION

In most medical laboratories, especially those established in connection with hosptial blood banks, two of the most common tests performed each shift are those of blood typing and antibody screening. The principal value of these tests is to discover incompatibilities between donor and recipient blood which could produce harmful and potentially lethal consequences.

In today's laboratories such tests are frequently performed by a tedious manual one-drop-at-a-time procedure which not only consumes a great deal of time but also promotes boredom and potential carelessness. Further, manual techniques utilizing droppers require uniform handling if uniform results are to be obtained and do not allow much room for the idiosyncracies of individual technicians. Thus only gross replication of results between technicians is within reasonable expectation. A further problem inherent in current laboratory procedures arises from the need to uncap and individually dispense each vial of anit-serum and red cell reagents each time the test procedure is performed. This constitutes up to as many as 200 exposures per vial of reagent to cross contamination and the technologist to the risk of AIDS, hepatitis and like blood carried threats.

Thus a true need exists for a device which has the ability to quickly and accurately provide readily reproducible laboratory results in a manner which substantially precludes the exposure of the reagents and technicians to contamination by foreign substances.

SUMMARY OF THE INVENTION

The present invention comprises a labortory device having a bifurcatable actuator plate assembly superposed to and in coaction with a support plate means for securing a plurality of pump-actuated pipettes therebetween and responsive to the actuation thereof to accurately dispense liquids therefrom during a single cycle of the actuator and means for readily establishing a preselected quantity for the replicate liquid injections.

Accordingly, it is a prime object of the present invention to provide a new and improved laboratory device for simultaneously innocuating a plurality of the same or dissimilar test materials, each with the same or one of a plurality of different test reagents, each having a predetermined relationship with the test material to produce a reaction having a meaningful response to a trained laboratory technician.

Another object of the present invention is to provide a new and improved medical laboratory device capable of providing rapid and readily duplicated test results which obviate the inherent and potentially hazardous inaccuracies of idiosyncratic manual measurements.

A further object of the present invention is to provide a new and improved medical laboratory device having a propensity of simultaneously processing a plurality of test samples, each with an innoculation conforming exactly to every other innoculation performed thereby.

Still another object of the present invention is to provide a new and improved reagent dispenser in which the reagent used therewithin is protected from airborne and contact contamination and the operator thereof is isolated from the risk of blood-carried disease.

A still further object of the present invention is to provide a new and improved laboratory device in which loss and waste of reagent is substantially eliminated and repriming can be readily effected without loss of reagent or contamination.

Still another object of the present invention is to provide a new and improved operating sub-assembly adapted to interchangably receive and coact with commercially available pipetors to enable a plurality of such pipetors to be used to simultaneously process a plurality of test samples.

These and still further objects as shall hereinafter appear are fulfilled by the present invention in a remarkably unexpected fashion as will be readily discerned from the following detailed description of exemplary embodiments, especially when read in conjunction with the accompanying drawing in which like parts bear like numerals throughout the several views.

THE DRAWINGS

THE PREFERRED EMBODIMENT

Figure 1:
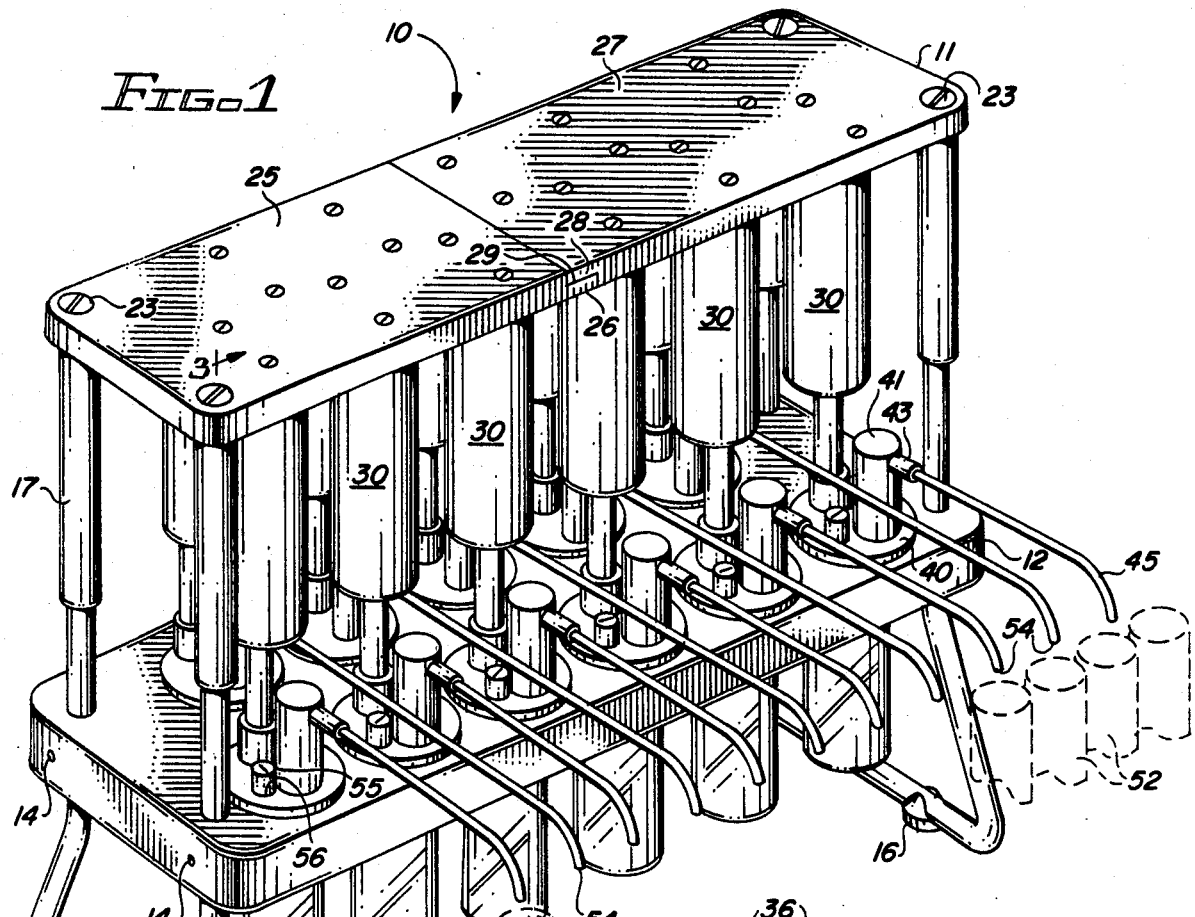
FIG. 1 is an isometric view of a device embodying the present invention.
Figure 2:
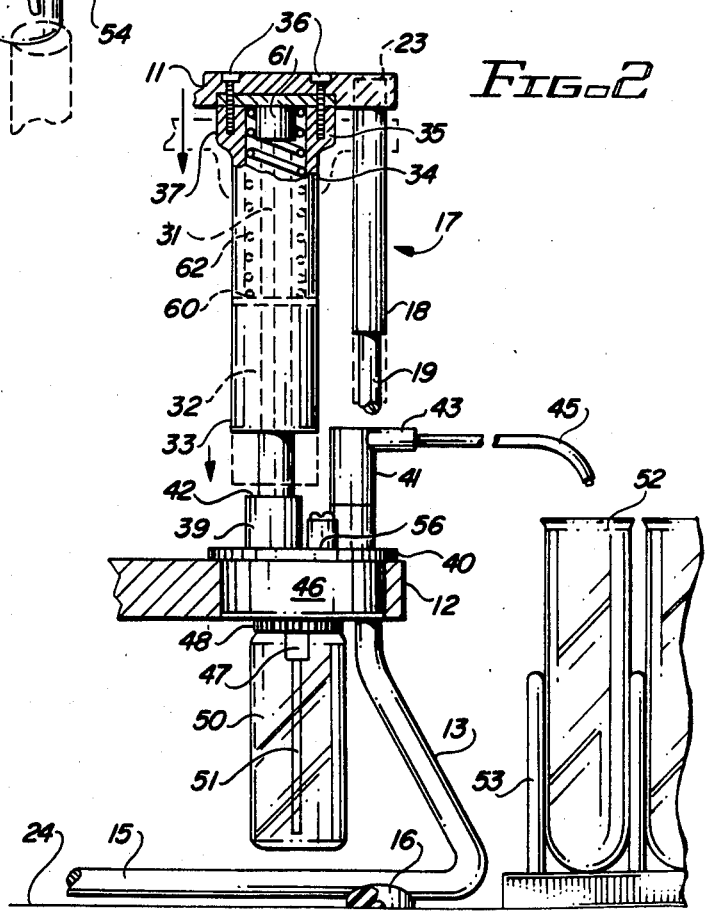
FIG. 2 is a side view of the device shown in FIG. 1.

Referring to the drawing, and particularly FIGS. 1 and 2 thereof, a laboratory device embodying the present invention is identified by the general reference 10. Each device 10 generally comprises an actuator plate assembly 11 disposed in generally parallel superposition to a support plate assembly 12 which in turn is mounted, at each end thereof, upon a let bracket 13 which is secured thereto by suitable fastener means such as screws 14. In the preferred embodiment hereof, actuator plate 11 and support plate 12 will have a rectangular configuration and will be disposed in substantial registry with each other and a bracket base portion 15 will interconnect adjacent leg brackets 13 and have suitable resilient foot members 16 secured thereto.

Operatively interposed between actuator plate assembly 11 and support plate assembly 12, are a plurality of support piston assemblies 17 disposed one at each of the corresponding corners of the rectangular assemblies 11, 12.

Figure 3:
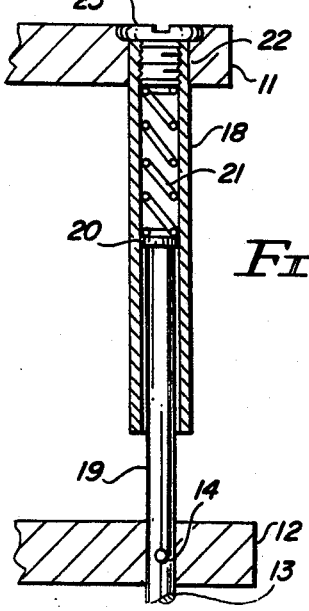
FIG. 3 is a cross-section taken on line 3—3 of FIG. 1.
Figure 4:
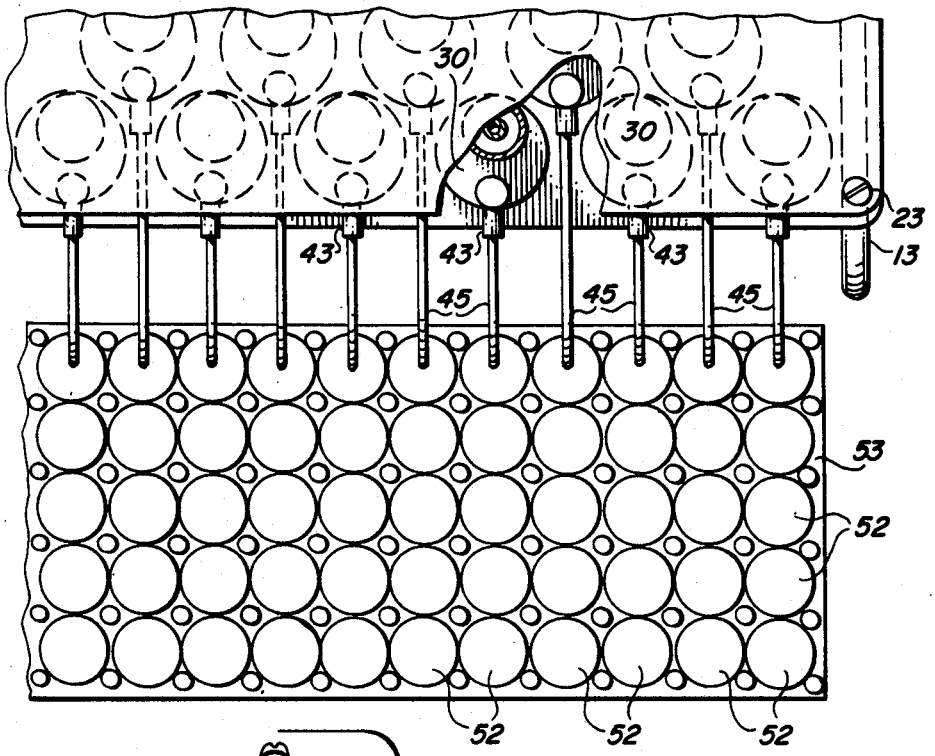
FIG. 4 is a plan view, partially broken away, of the device embodying the present invention in association with a reaction tray.

Each support piston assembly 17, as shown in FIG. 3, comprises an outer cylinder 18 having an elongated rod 19 telescopically inserted therewithin, rod 19 and having a plate member 20 disposed at the upper end thereof to engage and seat a compression spring 21 thereupon. When installed, cylinder 18 extends upwardly through an opening 22 defined in actuator plate assembly 11 and is secured thereto by the coaction of lock screw 23 therewith which likewise seats the distal end of compression spring 21 thereagainst.

In one embodiment of the present invention, each rod 19 may be integrally formed with and comprise the upper extension of a side of leg bracket 13 whereupon rod 19 is likewise secured to support plate assembly 12 by screws 14.

As thus described, actuator plate assembly 11 is movable toward support plate assembly 12 by the application of external pressure thereupon and is retractable from support plate assembly 12 by the reaction of the several compression springs 21 as each recoils between its corresponding plate member 20 and lock screw 23. As described, device 10 is supported by leg brackets 13 and base member 15 with resilient feet 16 seated upon a suitable bench surface 24.

In a preferred embodiment as shown in FIG. 1, actuator plate asembly 11 is bifurcated and comprises a first plate 25 having a stepped portion 26 formed at the distal end thereof and a second plate 27 having a reverse stepped portion 28 formed thereon adjacent the first stepped plate 25 so that stepped portions 26 and 28 mate in complementary engagement with each other to define a horizontal mating surface 29 therebetween for a purpose to be hereafter explained.

Figure 5:
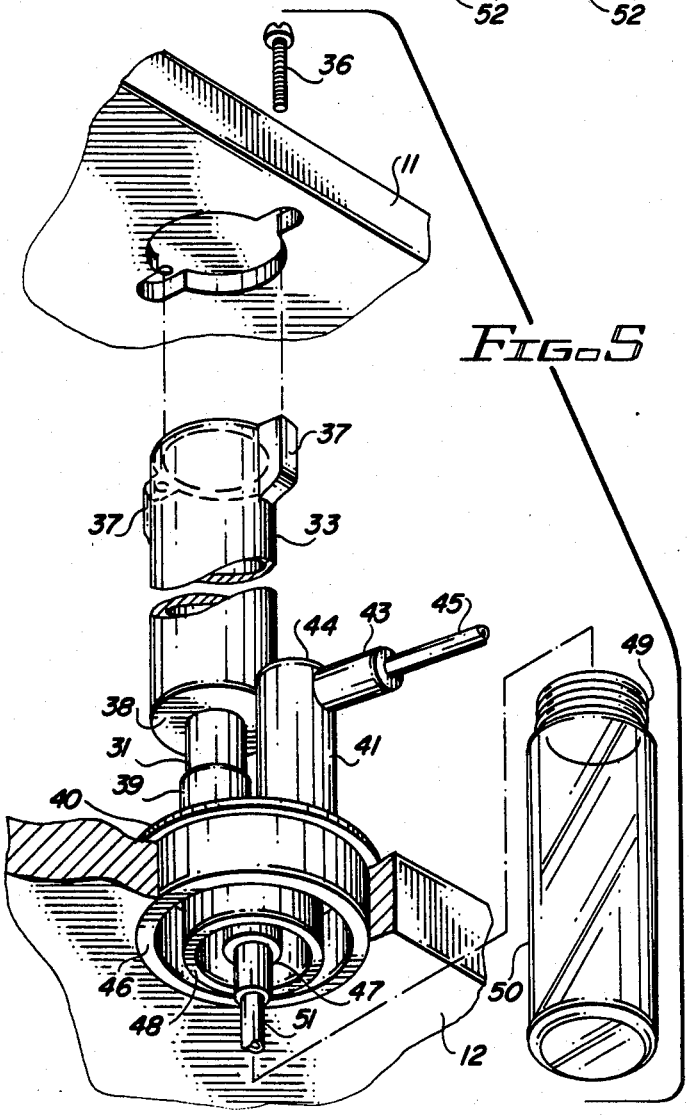
FIG. 5 is an exploded isometric view of a sub-assembly of the device of FIG. 1.

A plurality of piston actuated dispensers 30 are operatively interposed between actuator plate assembly 11 and the bench surface 22 and supported cooperatively by both activator plate assembly 11 and support plate assembly 12 in a manner to be now described with reference to FIGS. 1, 2 and 5.

Each piston actuated dispenser 30, twelve are shown in FIG. 1 but this number can be varied to more or less depending upon the exigencies of the particular labortory in which it is installed, comprises a Teflon® or glass plunger 31 axially disposed within a cylindrical glass plunger barrel 32 which in turn is mounted within a cylindrical plunger housing 33. Plunger housing 33 is closed at its upper end 34 by an annular retainer means 35 which is secured to actuator plate 11 by suitable fasteners such as screws 36 which extend therethrough into a ear-shaped retainer blocks 37 which are integrally formed on diameterically opposite sides of plunger housing 33. Plunger housing 33 is closed at its lower end by annular plate 38 integrally formed therewith in circumscription about barrel 32 in spaced dose regulating distance from a barrel mounting flange 39 which is secured to base plate 40 adjacent a dispensing cylinder 41. A nylon seating member 60 is mounted within plunger housing 33 in fixed circumscribing relationship with barrel 32 and coacts with seating means 61, formed upon retainer means 35 and depending axially therefrom, to seat and restrain plunger compression spring 62 therebetween. As will appear, the upper surface 42 of barrel mounting flange 39 serves as a detent to limit the reciprocal action of plunger housing 33. This action can be varied by the insertion of an approximately precalibrated dispenser volume spacer around plunger 31 upon surface 42 of flange 39.

Sleeve 43 is disposed into and extends outwardly from dispensing cylinder 41 adjacent the upper end 44 thereof into a sealing relationship with dispensing tube 45.

Base plate 40 is suitably secured to support plate assembly 12 and presents an annular shroud 46 depending downwardly therefrom through a suitable opening 47 defined therethrough which circumscribes a vial receptor 48 concentrically disposed within shroud 46 to receive and secure the threaded mouth 49 of a vial 50 therewithin. A suitable siphon 51 depends downwardly from base plate 40 through mouth 49 to establish communication between the contents of vial 50 and dispensing tube 45.

In one practice of the present invention utilizing the device hereof, each of the several piston actuated dispensers 30 or as many as are needed will be loaded with a vial 50. Such vials 50 may contain, for example, antiserum (anti-A, anti-B, anti-A,B, anti-D) for determining the forward Group and Rh type, control serum (Rh-hr control) and reagent red cells used for the detection of unexpected antibodies and the reverse typing of donor/recipient and like reagents. Each vial is screwed onto the vial cap receptor 48 associated with each dispenser. The tubing is primed by adjusting the priming hole 56 in the conventional fashion. Properly labeled test tubes 52 mounted in a suitable rack 53 (or other suitable receptacles such as a 96-well microplate) are positioned so that one of the dispensing tube 45 is aligned with a different one of the test cavities or tubes 52. The actuator plate assembly 11, or just first actuator plate 25 if less than all dispensing tubes 45 are required, is depressed, thereby releasing a predetermined volume of reagent into each of the test tubes, and thereafter release. Next, patient/donor serum (0.10 ml) is added manually with a pipette to the tubes containing the reagent red cells. A 3–5% red cell suspension is then made from the patient/donor cells with 0.9% NaCl and (0.05 ml) added to the test tubes containing antiserum. The tubes are then centrifuged and the reactions read and recorded by the technician.

The depression of first actuator plate 24 if it is desired to use only part of the piston actuated dispensers 30 or the depression of second plate 27 which by the interaction of stepped portions 26, 28 through mating surface 29 activates all of the piston actuated dispensers 30, compresses springs 21 simultaneously while activating the dispensers 30. Subsequent removal of pressure from the actuator plate assembly 11 will return the assembly 11 to its at rest position as springs 21 expand to their normal configuration. The actuation of actuator plate assembly 11 causes the liquid from vial 50 to be withdrawn therefrom by siphon 51 and delivered through dispensing cylinder 41, dispensing tube 45 to test cavity or tube 52. Reproducible results are assured by depressing actuator plate 11 until the reference line on barrel 32 is aligned with the bottom of plunger housing 33 which relationship, once established, remains constant during the procedure.

To apply the above apparatus to the accurate measurement and dispensing of liquids, dispensing tube 45 will be primed with the desired stock liquid from screw capped vial 50 by alternately compressing and releasing plunger 31 via actuator plate assembly 11 until liquid entirely fills the system and flows bubble free from dispensing tube 45. Withdrawal of liquid from vial 50 is accomplished by the upstroke of plunger 31 in response to the retraction of compression spring 62 between nylon seat 60 and upper spring seat 61 creating a vacuum allowing the liquid to fill glass barrel 32. The next downstroke of plunger 31 will enable expulsion of the withdrawn liquid via dispensing tube 45 into the associated test tube of cavity 52. The volume of liquid delivered through dispensing tube 45 can be varied by adjusting the dispenser 30 output to provide the appropriate proper delivery volume into plunger housing 33 or a dispenser having an incremental volume thereof, eg, when 50 μl are required, either a 50 μl or a 25 μl dispenser can be used, one with a single stroke and the other with a double stroke. This method of volume control allows accurate variable volumes to be dispensed from a number of pipettes with one downward movement of actuator plate assembly 11.

Note that dispensers 30 of the type used herewith are available commercially and are normally shipped preset at the maximum dispense volume. Other dispensing volumes may be obtained by installing a properly calibrated dispense volume spacer (not shown) upon the upper surface 42 of barrel mounting flange 39 around plunger 31 to restrict the length of the strokes of plunger 31 in accordance herewith. In my preferred embodiment, vial receptor 48 will be equipped to accept bottles with a 28 mm threaded opening although conventional screw-in adapters are available to permit ready conversion to 20,22 and 24 mm sized containers.

When dispenser 30 is assembled as described with flexible dispensing tube 45 in operative position, priming is obtained by unscrewing removable filter 55 from recirculation part or priming hole 56 and flexing tube 45 to insert the distal end 54 thereof into part 56 whereupon actuator plate assembly 11 is pressed and released until bubble-free reagent flows through transparent tube 45.

A preferred material for the construction of the dispenser assemblies is glass or teflon and the like. A number of dispensers suitable for use within the present invention are currently marketed by Tri-Continent Scientific, Inc., Grass Valley, Calif. under the names STAT-MATIC I® and Custom Dispensing Device. Where the reagents to be measured are compatible, polypropylene can also be used to construct the dispensers. The actuator plate assembly and the support plate assemblies are preferably formed of polypropylene or like corrosion resistant dense plastic, while the springs and screws are preferably formed of stainless steel, durable plastic or cast aluminum.

From the foregoing, it is readily apparent that all of the aforestated objectives have been fulfilled by the invention herein described and illustrated in a remarkably unexpected manner. It is of course understood that such modifications, alterations and adaptations that may readily occur to one skilled in the art to which the present invention pertains are included within the spirit of the present invention which is limited only by the scope of the claims appended hereto.

Accordingly what is claimed is:

1. A laboratory device for use on a laboratory support surface comprising an actuator plate assembly, said actuator plate assembly having a first plate and a second plate, said first plate having a stepped portion formed thereon adjacent said second plate, said second plate having a reverse stepped portion formed thereon adjacent said first plate, said stepped portions engaging each other on a mating surface defined therebetween; a support plate assembly disposed in generally parallel spaced relationship subposed to said actuator plate assembly; support means attached to said support plate assembly and depending therefrom into supporting engagement with a laboratory support surface; a plurality of spring biased piston means operatively interposed between said actuator plate assembly and said support plate assembly to permit said actuator assembly plate to move toward said suppport plate assembly in response to an external pressure selectively applied to said actuator plate assembly and to return said actuator plate assembly to its at rest position when said external force is removed; and a plurality of piston operated dispensers attached to a depending from said actuator plate assembly through said support plate assembly, each of said dispensers being responsive to the movement of said actuator plate to deliver a premeasured amount of reagent to a test cavity associated therewith.

2. A laboratory device according to claim 1 in which each of said spring biased piston means has an outer cylindrical member, an elongated rod member extending axially upwardly from said support means into telescoping relationship in said cylindrical member, said rod member having a plate formed on the leading end thereof within said cylindrical member, said cylindrical member being secured to said actuator plate assembly by cylinder closing securing means; and a compression spring operatively interposed between said securing means and said plate within said cylindrical member.

3. A laboratory device according to claim 2 in which each said rod member is integrally formed with the support means associated therewith.

4. A laboratory device for use on a laboratory support surface comprising an actuator plate assembly; a support plate assembly disposed in generally parallel spaced relationship subposed to said acutator plate assembly; support means attached to said support plate assembly and depending therefrom into supporting engagement with a laboratory support surface; a plurality of spring biased piston means operatively interposed between said actuator plate assembly and said support plate assembly to permit said actuator assembly plate to move toward said suppport plate assembly in response to an external pressure selectively applied to said actuator plate assembly and to return said actuator plate assembly to its at rest position when said external force is removed; and a plurality of piston operated dispensers attached to and depending from said actuator plate assembly through said support plate assembly, each of said dispensers being responsive to the movement of said actuator plate to deliver a premeasured amount of reagent to a test cavity associated therewith, each of said piston operated dispensers having a plunger, a cylindrical plunger barrel circumscribing said plunger, and a cylindrical plunger housing disposed in circumscribing relationship about said plunger barrel and said plunger; first spring seating means enclosing said plunger barrel and depending therefrom, second spring seating means circumscribing said plunger barrel in spaced operative relationship to said first spring seating means; compression spring means operatively interposed between said first spring seating means and said second spring seating means to restore plunger housing to its at rest position when no pressure is applied to said actuator plate means.

5. A laboratory device according to claim 4 in which said actuator plate assembly comprises a first plate and a second plate, said first plate having a stepped portion formed thereon adjacent said second plate, said second plate having reverse stepped portion formed thereon adjacent said first plate, said stepped portions engaging each other on a mating surface defined therebetween.

6. A laboratory device according to claim 4 in which the stroke of said plunger relative to said plunger housing is limiting by plunger detent means disposed axially therebeneath.

7. A laboratory device according to claim 6 in which said actuator plate assembly comprises a first plate and a second plate, said first plate having a stepped portion formed thereon adjacent said second plate, said second plate having a reverse stepped portion formed thereon adjacent said first plate, said stepped portions engaging each other on a mating surface defined therebetween.

8. A laboratory device according to claim 6 in which each of said spring biased piston means has an outer cylindrical member, an elongated rod member extending axially upwardly from said support means into telescoping relationship in said cylindrical member, said rod member having a plate formed on the leading end thereof within said cylindrical member, said cylindrical member being secured to said actuator plate assembly by cylinder closing securing means; and a compression spring operatively interposed between said securing means and said plate within said cylindrical member.

9. A laboratory device according to claim 8 in which each said rod member is integrally formed with the support means associated therewith.

10. A laboratory device according to claim 4 in which each of said spring biased piston means has an outer cylindrical member, an elongated rod member extending axially upwardly from said support means into telescoping relationship in said cylindrical member, said rod member having a plate formed on the leading end thereof within said cylindrical member, said cylindrical member being secured to said actuator plate assembly by cylinder closing securing means; and a compression spring operatively interposed between said securing means and said plate within said cylindrical member.

11. A laboratory device according to claim 10 in which each said rod member is integrally formed with the support means associated therewith.

* * * * *